US008668549B2

(12) United States Patent
Solotoff

(10) Patent No.: US 8,668,549 B2
(45) Date of Patent: Mar. 11, 2014

(54) BRASSIERE WITH ADJUSTABLE SUPPORT

(76) Inventor: Brandon Solotoff, Nutley, NJ (US)

( * ) Notice: Subject to any disclaimer, the term of this patent is extended or adjusted under 35 U.S.C. 154(b) by 269 days.

(21) Appl. No.: 13/068,100

(22) Filed: May 2, 2011

(65) Prior Publication Data

US 2012/0208433 A1 Aug. 16, 2012

Related U.S. Application Data

(60) Provisional application No. 61/463,352, filed on Feb. 15, 2011, provisional application No. 61/518,168, filed on Apr. 29, 2011.

(51) Int. Cl.
*A41C 3/00* (2006.01)

(52) U.S. Cl.
USPC ..... 450/60; 450/63

(58) Field of Classification Search
USPC ..... 450/59–63
See application file for complete search history.

(56) References Cited

U.S. PATENT DOCUMENTS

| | | | | | |
|---|---|---|---|---|---|
| 2,135,094 | A | | 11/1938 | Alberts | |
| 2,175,676 | A | * | 10/1939 | Walters | 450/63 |
| 2,421,448 | A | * | 6/1947 | Witkower | 450/63 |
| 2,621,328 | A | * | 12/1952 | Duchnofskey | 450/53 |
| 2,734,193 | A | * | 2/1956 | Panes | 450/63 |
| 3,747,606 | A | | 7/1973 | Tareau et al. | |
| 4,632,118 | A | | 12/1986 | Garutso | |
| 5,590,443 | A | * | 1/1997 | Fildan | 24/200 |
| 6,422,917 | B1 | | 7/2002 | Rose et al. | |
| 7,232,359 | B1 | | 6/2007 | Richardson | |
| 7,452,260 | B2 | * | 11/2008 | Redenius | 450/63 |
| 7,497,760 | B2 | * | 3/2009 | Redenius | 450/60 |
| 7,607,966 | B1 | | 10/2009 | Fox | |
| 7,677,951 | B2 | * | 3/2010 | Redenius | 450/60 |
| 7,695,343 | B2 | | 4/2010 | Nobbs | |
| 8,177,602 | B1 | | 5/2012 | Kaytes | |
| 8,187,054 | B2 | * | 5/2012 | Redenius | 450/59 |
| 2005/0277364 | A1 | * | 12/2005 | Redenius | 450/41 |
| 2007/0232190 | A1 | * | 10/2007 | Redenius | 450/41 |
| 2009/0031731 | A1 | * | 2/2009 | Ziminsky et al. | 60/777 |
| 2010/0130098 | A1 | | 5/2010 | Kammerer | |
| 2010/0210179 | A1 | * | 8/2010 | Redenius | 450/63 |
| 2010/0317257 | A1 | | 12/2010 | Campbell | |

* cited by examiner

*Primary Examiner* — Gloria Hale
(74) *Attorney, Agent, or Firm* — Thomas A. O'Rourke; Booner & O'Rourke, LLP

(57) ABSTRACT

An adjustable support brassiere comprises the traditional bra elements of a bra band with closure; breast cups secured thereto; and respective shoulder straps. Adjustability may comprise mini support cups pivotally attached at a selective location on each breast cup. A respective support strap may be secured to a portion of each mini support cup, with a distal end adjustably securable to the shoulder strap to be moveable between at least first and second positions to cause pivoting of the mini support cup to produce directional support according to a desirable lifting vector. Adjustment of the support strap may produce a lifting vector to provide directional support comprising substantially vertical support and outward separating support to enhance the women's figure, which is healthier for breast tissue than the typical inward displacement of the woman's breasts. A second embodiment may utilize a translating mini support cup and a gathered elastic member.

48 Claims, 3 Drawing Sheets

BRASSIERE WITH ADJUSTABLE SUPPORT

CROSS REFERENCES TO RELATED APPLICATIONS

This application claims priority on U.S. Provisional Application Ser. No. 61/463,352 filed on Feb. 15, 2011 and U.S. Provisional Application Ser. No. 61/518,168, filed Apr. 29, 2011, the disclosures of which are incorporated herein by reference.

FIELD OF THE INVENTION

The present invention relates to improvements in brassieres, and more particularly to brassieres that provide adjustable support.

BACKGROUND OF THE INVENTION

Over the course of history, undergarments dedicated to providing support for, and/or for accentuating a woman's physique, particularly her breasts, have changed, in part, according to societal norms. It is well known that the Minoan women living on the Greek isle of Crete, around 2500 B.C., wore bra-like garments that served to lift their bare breasts out from their clothes. During the 1500s and later, corsets were worn, which tended to provide upward support for the wearer's breasts. In the latter part of the 1800s, the corset was split by some into a girdle for torso support and an upper device suspended from the shoulders for breast support. Such devices are found in various historic sources and reported in modern published accounts such as "Bra: A Thousand Years of Style, Support & Seduction," by Stephanie Pedersen.

During the late Victorian period in the United Kingdom, a "bust bodice," commonly referred to then as a "BB", was dedicated to providing basic shape and support for a woman's breasts by creating a mono-bosom effect, with examples being found today in English museums (see http://museums.leics.gov.uk/collections-on-line/GetObjectAction-.do?objectKey=103636). The bust bodice was essentially just a frilled, white cotton cloth that surrounded both breasts and was supported by a pair of straps, and fastened at the back by laces and/or a button.

Earliest use of the term "brassiere" in the United States is considered to be by the Syracuse Evening Herald in March 1893, in referring to a six-inch straight boned band being necessary for fashionable gowns at the time, while Vogue magazine used the term in 1907, and it was first adopted into the Oxford English Dictionary in 1911. However, first use of the term "Brassiere" in a patent was by Mary Jacob in the 1914 U.S. Pat. No. 1,115,674. But ironically, although she is often credited as inventing the first "modern bra," the device did not comprise cups for individual support of the wearer's breasts, and more closely resembled its progeny in the form of the bust bodice. Some tend to credit H. S. Lesher for his "Combined Breast Pads and Arm-Pit Shield" shown in the 1859 U.S. Pat. No 24,033, as perhaps being the inventor of the bra, since part of its function is described as providing "a symmetrical rotundity to their breasts," Certain historians attribute Luman L. Chapman's 1863 U.S. Pat. No. 40,907 for an improved "Corset," as being the ""proto-brassiere." Olivia P. Flynt also received multiple U.S. patents for articles of clothing, and in 1876 received U.S. Pat. No 173,611 for a "Bust Supporter", which states, among other things, that it "adapted to ladies having large breasts," that it "was specially designed as a bust support and improver" being designed for "producing a more comely outline and comfortable feeling than the corset," and that it "will be used instead of and take the pace of the corset." Many others may justifiably attribute invention of the first modern bra, which was patented and unveiled at the Exhibition of 1889 in France, by corset-maker Herminie Cadolle, She displayed her bra-like device- part of a two-piece corset, that was called Bien-être," meaning "Well-Being" (although it was initially called the "corselet gorge"), which was sold as a health aid. The first patenting within the U.S. of something closely resembling the modern bra was by Marie Tucek for her "Breast Supporter." The Tucek breast supporter received protection under the 1893 U.S. Pat. No. 494,397, and comprised a pair of cups that provided support through a pair of shoulder straps, and outwardly resembled the contemporary brassiere.

Today, a woman's bra functions not only to provide basic support, but also must fulfill ever increasing demands in terms of it being fashionable and shape-enhancing. One current demand is that the woman may use the bra to appear professional by daytime, which in some social circles or offices, perhaps even is obligated to appear conservatively, but once leaving the professional environment to enjoy late afternoon and evening social events, the woman may wish to use it to enhance her figure and appear more voluptuous, even seductively enhanced and suggestive. The brassiere invention disclosed herein permits a woman to achieve those results, by giving her several options with which she may either tone down or accentuate her figure.

OBJECTS OF THE INVENTION

It is an object of the invention to provide a bra that allows a woman to easily and conveniently adjust the support provided by the bra's cups.

It is another object of the invention to provide an adjustable bra that enhances the appearance of a woman's physique by permitting vertical adjustments to the lift being provided to her breasts.

It is a further object of the invention to provide a bra that provides a lift enhancing feature that may be adjusted while the woman is wearing the bra.

It is another object of the invention to provide a bra with an adjustable lift feature that provides vertical support, and with outward separation for healthier support of the woman's breast tissue.

It is another object of the invention to provide a bra with an adjustable lift feature that provides vertical support, and with outward separation for a more attractive fit.

Further objects and advantages of the invention will become apparent from the following description and claims, and from the accompanying drawings.

SUMMARY OF THE INVENTION

The bra of the present invention has the ability to be adjusted to provide various degrees of lift in the vertical direction, along with some amount of separating support to enhance the woman's figure in a healthier manner than is provided by inward breast-displacing bra types. The adjustable support brassiere may comprise: a bra band; at least one breast cup, which may be stretchable, with each breast cup being secured to a portion of the bra band; and respective shoulder straps. The breast cup(s) may preferably comprise an elastic material. Lifting and separation may be provided by a mini support cup located within at least one of the breast cups, and more preferably each of the breast cups. One ends of the mini support cup may be attached at a selective location on the breast cup. A support strap for each of the breast cups may have a portion being secured to the mini support cup, and an end being adjustably securable to the respective shoulder strap to be moveable between at least first and second positions to cause movement of the mini support cup to produce directional support according to a lifting vector.

In one embodiment, the mini support cup is pivotally attached at a first selective location. The end of the support strap may be adjusted from a first position to at least a second position, so that the mini support cup rotates to have the lifting vector producing directional support principally comprising only vertical support. With the mini support cup being pivotally attached at a second selective location, the mini support cup rotates with the lifting vector producing directional support comprising substantially vertical support with some outward separating support as well. The bra may be configured to only provide only one type of lifting vector, or if on-the-fly adjustability is desired, a snap fastener may permit movement by the wearer between multiple selective pivotal locations.

The support strap may generally span diagonally across the breast cup, and may also have one end attaching at a lower inside portion of the breast cup, and with the other end of the support strap attaching to the shoulder strap to be generally centrally located with respect to the breast cup, which may serve to enhance separation. The mini support cup may be comprised of a curved fabric having a flexible stiffening member secured therein. One or more secondary layers of padding may be positioned between the breast cup and the mini support cup/support strap combination to mask the operation of those components. Also, a smooth liner such as a tricot liner may be secured to an inner portion of the breast cups to cover the mini support cup and support strap, to enable its operation to be relatively comfortable.

An alternate embodiment of the bra of the present invention may utilize a mini support cup that translates by the adjustment of the support strap, by stretching a gathered elastic member, which may have one side being secured to a portion of a bottom of each breast cup, and a another side secured to the mini support cup. The gathered elastic may expand to fill a gap formed between the mini support cup and breast cup bottom, and may also serve to provide a positional restoring force to the mini support cup, when the wearer seeks to accomplish downward adjustment to the lifting device.

DETAILED DESCRIPTION OF THE INVENTION

Figure 1:
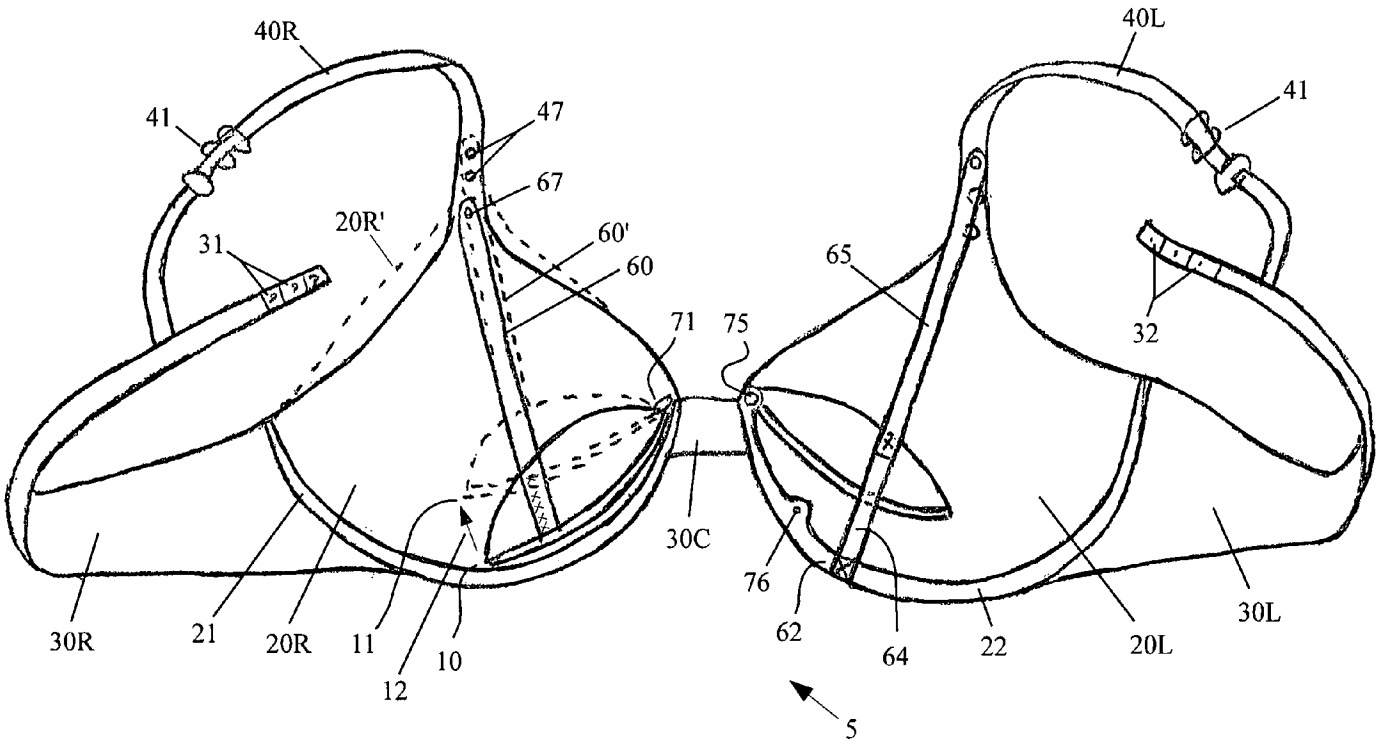
FIG. 1 shows a rear perspective view of a first embodiment of a pivotally adjustable directional support bra of the current invention.

The present invention relates to an adjustable bra that enables a user to easily and conveniently adjust the amount of lift provided, and in another embodiment it may also permit adjustment to the direction of support provided by the garment. FIG. 1 shows a rear perspective view of one embodiment, in the form of the adjustable bra 5. The adjustable bra 5 may be constructed, in part, in the same way that a convention bra is assembled. Adjustable bra 5 may have one or two breast cups, and may be comprised of a left breast cup 20L and a right breast cup 20R. The breast cups may be formed of a sturdy inelastic material, or may alternatively be constructed of an elastic material which provides some support, but is nonetheless elastically stretchable or deformable to a certain degree. The bottom of each breast cup 20L and 20R may contain underwire 21 and 22, respectfully.

Figure 1A:
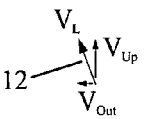
FIG. 1A shows a lift vector provided by the bra of FIG. 1 being resolved into vertical and horizontal lift components.
Figure 1B:
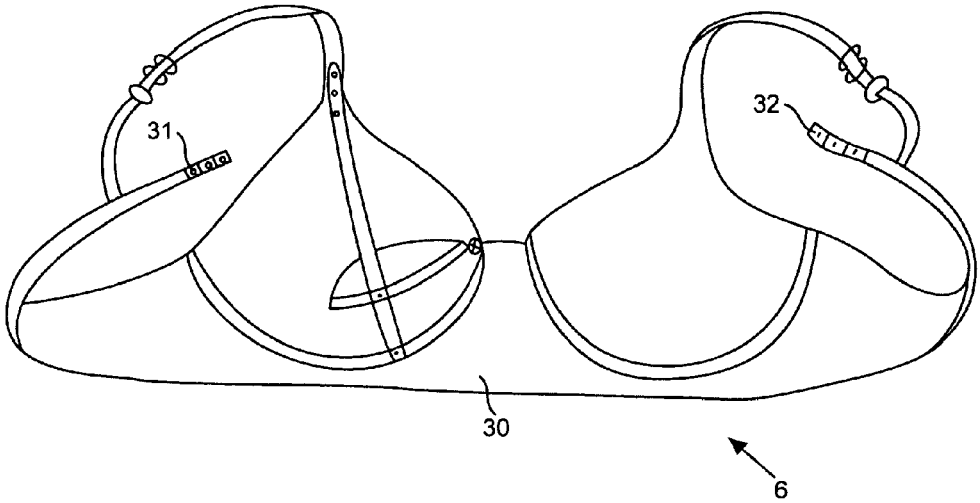
FIG. 1B shows an alternative embodiment of the bra of FIG. 1, having a continuous bra band.

The breast cups 20L and 20R may be properly spaced apart and situated to enclose a woman's breasts, by appropriate attachment to an encircling band- the bra band that is used to attach the bra about a women's torso. Adjustable bra 5 may comprise three distinct bra band segments, 30L, 30R and 30C, where the bra band 30L is attached to and extends away from the left breast cup 20L, the bra band 30R is attached to and extends away from the right breast cup 20R, and the bra band 30C is attached to and extends in between both breasts cups, 20L and 20R. As seen for bra 6 in FIG. 1B, a single bra band 30 may alternatively be used in place of the multiple bra band segments.

The single bra band 30 may be continuous at the back of the wearer, so that the garment may resemble a pull-on type of bra, similar to many sports bras today. Where there is either the single bra band 30 or the segmented bra bands 30L, 30R and 30C, and where they are not integrally connected, they may be fastened together to secure the bra about the women's torso using a typical means of closure, such as a hook 31 and eye 32 joining system, or a button and button hole, etc. It is also common today for bras to be constructed with bra band 30C split in two pieces 30Ci and 30Cii, while bra bands 30L and 30R are integrally connected, and with a closure located on the split two-piece bands 30Ci and 30Cii using a front closure means, such as those available from Sew Sassy Fabrics (see www.sewsassy.com/BraProducts/Closures.html the disclosures of which are incorporated herein by reference).

As is typical for most brassieres, the bra 5 of the present invention may have respective shoulder straps 40L and 40R, for each of the breast cups 20L and 20R, where the shoulder straps have a first end extending from an upper portion of each breast cup, and a second end secured to a portion of the bra band. The shoulder strap may preferably be centrally located on the upper portion of the breast cup, to provide a better range of directional support as discussed hereinafter. The shoulder strap, depending on the construction of the bra, may be formed of material, of which a portion may be integral with the breast cup itself. Each shoulder strap may have a clip 41 to permit adjustments to the length of the strap.

The adjustable bra 5 contains elements arranged in a very distinct manner, being unlike the ordinary brassiere or even specialty brassieres, to thereby be peculiarly operable therein to provide adjustable direction-specific lifting of the wearer's breast. However, because it is commonly known that a woman's breast tissue remains healthier when properly supported and provided with some small degree of separation, rather than being forced inwardly, the arrangement of those elements will be particularly directed to spontaneously permit adjustments to the lifting of a woman's breasts for figure enhancement, along with further refinements in the adjustability to produce greater or lesser amounts of separation as desired by the user.

Figure 3:
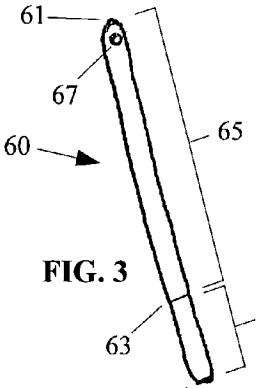
FIG. 3 is a front view of the support strap.
Figure 2:
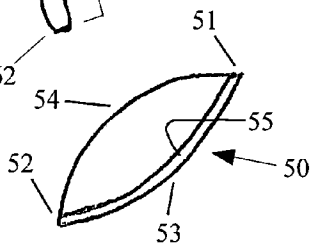
FIG. 2 is a front view of the mini support cup.

Those elements, which are illustrated in FIGS. 2 and 3, are the mini support cup 50 and support strap 60. The mini support cup 50 may have a first end 51 and a second end 52, and may be made of a generally inelastic material. The outline of the material of the mini support cup 50 may take any suitable shape, and in one embodiment, as shown in FIG. 2, it may have a lower curved edge 53 and an upper curved edge 54 to generally resemble an elliptical shape. The lower edge 53 may have a flexible stiffening member 52 secured thereto, which may be analogously formed as the underwire of the breast cups, and may have corresponding curvature. The flexible stiffening member 52 may be bonded to the material of the mini support cup, or the mini cup material may be sewn to form a pocket with the stiffening member 52 being received therein, or it may be attached using any other means known within the art for securing bra underwire.

Figure 4A:
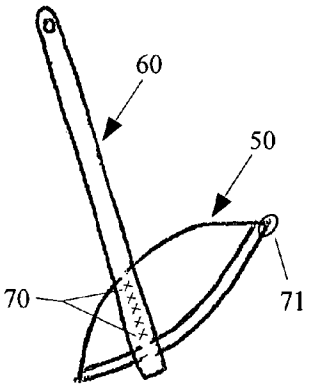
FIG. 4A is a front view of the support strap secured to the mini support cup using stitching across the interface.

The support strap 60 may have a first end 61 and a second end 62. As seen in FIG. 4A, the support strap 60 may be secured to the mini support cup using any means available in the art, and in one embodiment, they may be stitched together using a series of stitches 70 across the length of the faying surface area between the two members. The support strap 60 may be formed of an elastic material that may be somewhat less stretchy than typical elastic, so that its movement may better serve to cause corresponding movement of the mini support cup, as described hereinafter.

A mini support cup 50 and support strap 60 combination may be secured at the first mini support cup end 51 using loops of threading 71, which are generally illustrated in FIG. 4A, to a selective location 15 on each of the breast cups 20L and 20R (see FIG. 1), so as to permit pivotal movement of the mini support cups with respect to the breast cups. The upper (first) end 61 of the support strap 60 may have a fastening means 67 for securing the support strap to the respective shoulder strap 40L or 40R. The fastening means may be a snap fastener, or may be traditional brassiere hook and eye fasteners, whereby fastening means 67 on the support strap may comprise a hook, and the shoulder strap may have attached thereto, a series of eyelets 47 that progressively are located higher on the shoulder strap.

With the support strap 60 being in the unadjusted position on the right breast cup (left side of FIG. 1), the stiffening member 52 of the mini support cup 50 may generally be adjacent to the bottom of the breast cup. Where the bra includes an underwire 21/22, the wire may have a joggle in its curvature so that the stiffening member 52 of the mini support cup may be nested therein when occupying the unadjusted position. Adjustment of the support strap so that its hook 67 is mated with an upper eye 47 on the shoulder strap, causes support strap 60' to occupy one of several possible vertically adjusted positions, thereby upwardly lifting the wearer's breast beyond that which was previously provided by the bra's breast cup 20R. As the breast is lifted up by the mini support cup 50, the upper portion of the breast cup may stretch elastically to the dashed line boundary of breast cup 20R'.

An examination of the geometry of the arrangement reveals that several factors synergistically contribute to the mini support cup being able to produce a desirable lifting vector $V_L$, approximated by vector 12, which results in a substantial amount of vertical support, $V_{up}$ (FIG. 1A), and a sufficient amount of outward separating support, $V_{out}$, for the wearer's breasts. This serves to enhance the woman's physique in a more healthy fashion. The first factor is attachment of the threads 71 that permit pivoting, at a right central position of the breast cup, being proximate to the central bra band 30C. The second factor is the extent of the mini support cup, which is approximately equal to, or even somewhat less than, one-half of the entire underwire support of the full breast cup 20R. This serves to "push" the breast upward, and slightly outward, at least for the small distances that the mini cup 50 is caused to pivot by adjustment of the support strap 60 to a higher location. A third factor may be the orientation of the support strap relative to the overall bra arrangement. The support strap 60 may generally span diagonally across the breast cup, with the second end of the support strap attaching at a position between the first end 51 and second end 52 of the mini support cup 50, so that the stiffening member 52 of the mini support cup may thus provide less rigid, cantilevered support, and with the first end of said support strap attaching to the shoulder strap at either of the first or second positions to be generally centrally located with respect to said breast cup. Where the shoulder straps 40R and 40L and the bra bands 30R and 30L are constructed of material characteristically possessing very little elasticity, and the central bra band is made using material with somewhat more elasticity, the upward adjustment of the support strap may also tend to naturally cause separation, which may be accompanied by some stretching of bra band 30C.

An alternate embodiment of the mini support cup attachment is shown on the left breast cup 20L in FIG. 1, in which a snap fastener is used to pivotally secure the mini support cup to the breast cup. The snap fastener may be the male and female snap members disclosed by expired U.S. Pat. No. 3,975,803 to Katayama, the disclosures of which are incorporated herein by reference. Any other suitable snap known in the art may also be used. The snap may be used to attach the mini support cup to a portion of the underwire, rather than the breast cup material. The arrangement of the left breast cup 20L also illustrates the effect of moving the pivot point of the mini support cup from the first position 75 (71 for the threaded loops on the right breast cup) to the second position 76, which, when positioned correctly, being approximately as shown, may serve to produce vertical lifting of the breast, but with hardly any outward lifting.

Figure 4B:
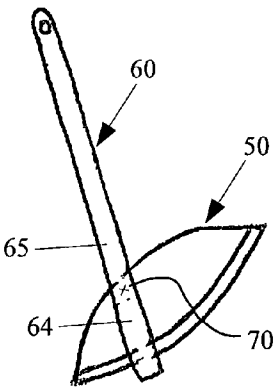
FIG. 4B is a front view of the support strap secured to the mini support cup using stitching only at or near an upper edge of the mini support cup.

Another alternative feature shown on the left breast cup arrangement in FIG. 1 concerns the construction of the support strap 60 and its attachment to the bra. As seen in FIG. 3, the support strap 60 may be constructed of two distinctly different materials, where the upper portion 65 may be a generally inelastic material that transitions at point 63 into a lower portion 64 that may be a fairly elastic material. Also, as seen in FIG. 4B, attachment of the support strap 60 to the mini support cup may comprise stitching 70 only at or very near the upper edge 54 of the mini support cup 50. Once this mini support cup and support strap combination is pivotally mounted to the bra, using any of the previously mentioned methods/arrangements, the second end 62 of the support strap may be secured to the lower breast cup periphery or the underwire 22, so that when the support strap is adjusted upward, the inelastic portion 65 may correspondingly lift the mini support cup, while the lower portion 64 expands elastically. This lower elastic portion 64 may provide a restoring force for the mini support cup 50 when the wearer of the bra decides to downwardly adjust the support strap and relocate it to the unadjusted position, or to just to one that provides less lift to result in a less enhanced bust contour.

Figure 5:
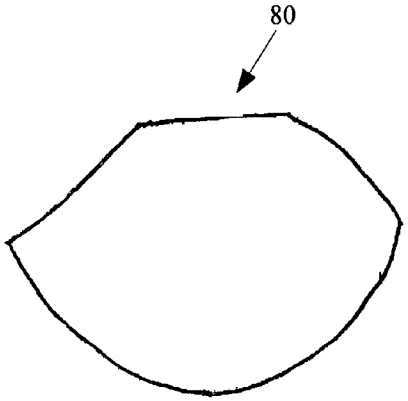
FIG. 5 is a front view of padding usable in conjunction with the bras of FIGS. 1 and 1B to conceal the parts therein.

To better conceal the support strap 60 and the mini support cup, the breast cups 20L and 20R may be made of a thick pad of elastic material. Alternatively, a separate padding layer 80 (FIG. 5) may be added between the breast cup and the mini support cup / strap combination. Also, for better comfort to the wearer, the interior of the breast cup may be covered with a smooth tricot liner.

Figure 6:
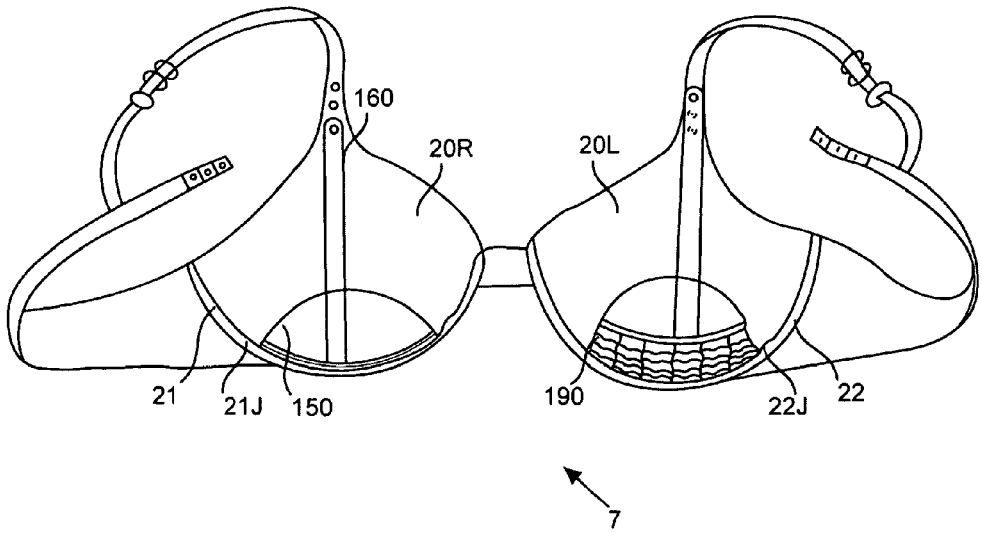
FIG. 6 shows a second embodiment of the bra of the present invention, in which a translating mini support cup is provided.

A second, slightly different embodiment of the current invention is shown for the bra 7, which is illustrated in FIG. 6.

Bra 7 may use a translating mini support cup 150 instead of the pivoting mini support cup 50 used by brassieres 5 and 6. Mini support cup 150 may be constructed the same as support cup 50, but may have attached thereto an elastic member which may be an elastic member that is expandable when the mini support cup is raised or a gathered member 190 preferably made from an elastic material. Elastic member and the mini support cup may be made according to any currently available methods, including, but not limited to, those shown by U.S. Pat. No. 4,634,482 to Lammers, by U.S. Pat. No. 4,842,666 to Werenicz, and by U.S. Pat. No. 6,491,776 to Alper, with the disclosures of each being incorporated herein by reference. A support strap 160 may similarly be attached to the mini support cup 150, which may nest into a recess formed by a joggle (21J and 22J) in the underwire 21 and 22 at the bottom of each breast cup. When the wearer of bra 7 decides to enhance her figure, she may, as before, upwardly adjust the support strap 160, which may cause expansion of the gathered elastic member 190 to fill in the gap. Once the user decides to downwardly adjust the support strap 160 and releases it from the catch, the gathered elastic acts like a spring to restore the position of the mini support cup 150. The arrangement is shown in the unadjusted position for the right breast cup 20R, and in the upper most adjusted position for the left breast cup 20L in FIG. 6.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

I claim:

1. A brassiere comprising:

a bra band;

at least one breast cup; each said at least one breast cup secured to a portion of said bra band;

a shoulder strap for each of said at least one breast cup;

a mini support cup for each of said at least one breast cup, having a first end and a second end; said first end of said mini support cup pivotally attached at a selective pivotal location on said at least one breast cup; and a support strap for each of said at least one breast cup, a portion of said support strap secured to a portion of said mini support cup, with a first end of said support strap adjustably securable to said shoulder strap and movable between at least first and second positions on said shoulder strap to provide for pivoting of said mini support cup at said selective pivotal location to produce desired lift of a wearer's breast therein.

2. The adjustable support bra of claim 1 wherein when said support strap first end is adjusted from said first position to said second position, and when said mini support cup is pivotally attached at a first selective pivotal location, said mini support cup rotates about said first pivotal location, for said desired lift to thereby provide vertical lift.

3. The adjustable support bra of claim 2 wherein when said support strap first end is adjusted from said first position to said second position, and when said mini support cup is pivotally attached at a second selective pivotal location, said mini support cup rotates about said second pivotal location for said desired lift to thereby provide both a vertical component of lift, being generally away from said bra band, and a horizontal component of lift, being generally parallel with said bra band.

4. The adjustable support bra of claim 3 wherein said at least one breast cup comprises an elastic material.

5. The adjustable support bra of claim 4 wherein said support strap has a second end secured to a portion of said at least one breast cup, and wherein said securing of said portion of said support strap to said mini support cup comprises securing a portion of said support strap at a location between said first and second ends of said support strap, to said mini support cup.

6. The adjustable support bra of claim 5 wherein said securing of said portion of said support strap to said mini support cup comprises securing said portion of said support strap to an upper edge of said mini support cup.

7. The adjustable support bra of claim 6 wherein said support strap comprises a first portion and a second portion; said first portion being between said first end of said support strap and said location of said attachment to said mini support cup, with said first portion comprising a substantially inelastic material; and said second portion being between said location of said attachment of said portion of said support strap at said mini support cup and said second, with said second portion being formed with an elastic material.

8. The adjustable support bra of claim 7 further comprising a bra band closure means.

9. An adjustable support brassiere comprising:

a bra band;

at least one stretchable breast cup; each of said at least one breast cup being secured to a portion of said bra band; said at least one breast cup comprising an elastic material;

a shoulder strap for each said at least one breast cup, said shoulder strap, having a first end extending from a portion of said at least one stretchable breast cup, and a second end secured to said bra band;

a mini support cup configured to be movable within said breast cup from a first position to at least a second position for each said at least one breast cup, said mini support cup having a first end and a second end; said first end of said mini support cup pivotally attached to said at least one breast cup with a pivotal attachment means, said mini support cup configured to produce a first desired lifting vector when said mini support cup is moved from said first position to said second position in said at least one breast cup; and a support strap for each said at least one breast cup, a portion of said support strap secured to a portion of said mini support cup, said support strap having a first end adjustably securable to said shoulder strap using an attachment means configured for attachment of said support strap at two or more locations on said shoulder strap, and thereby moveable between at least first and second support strap positions to cause said mini support cup to move between said first position and said at least a second mini support cup position, to produce directional support according to said desired lifting vector.

10. The adjustable support bra of claim 9 wherein said shoulder strap extends from a substantially central portion of said breast cup, with respect to said bra band; and wherein said support strap generally spans diagonally across said breast cup, with said first end of said support strap adjustably attached to said shoulder strap at either of said first or second positions.

11. The adjustable support bra of claim 10 wherein said at least one stretchable breast cup comprises a first breast cup attached at a first location on said bra band, and a second breast cup attached at a second location on said bra band at a distance from said first breast cup, with a corresponding first shoulder strap, first mini support cup, and first support strap for said first breast cup, and a corresponding second shoulder strap, second mini support cup, and second support strap for said second breast cup; and wherein said first mini support cup is pivotally attached at a selective pivotal location on said first breast cup, and said second mini support cup is pivotally attached at a selective pivotal location on said second breast cup.

12. The adjustable support bra of claim 11 wherein when said first end of each of said first and second support straps is respectively adjusted from said first position to said second position, said first and second mini support cups pivot with said lifting vector for each breast cup producing directional support comprising a vertical component of support being generally away from said bra band, and a horizontal outward separating component of support being generally along said bra band, whereby said outward separating support for each said first and second breast cups is provided by said horizontal component for said lifting vector along said bra band for said first and second mini support cups being in opposite directions.

13. The adjustable support bra of claim 12 wherein each said first and second mini support cups comprise a pad and a flexible stiffening member secured at a bottom of said pad.

14. The adjustable support bra of claim 13 further comprising a tricot liner being secured to an inner portion of each said first and second breast cups, and configured to cover said mini support cup and to cover a portion of said support strap.

15. The adjustable support bra of claim 14 further comprising a secondary padding layer, said secondary padding layer being positioned between each said first and second breast cups, and said corresponding mini support cup.

16. The adjustable support bra of claim 15 further comprising a curved underwire in a bottom of each said first and second breast cups.

17. The adjustable support bra of claim 16 wherein said flexible stiffening member is curved to correspond to a portion of said curved underwire.

18. The adjustable support bra of claim 17 wherein said pad of said mini support cup pad comprises a generally elliptically-shaped pad.

19. The adjustable support bra of claim 13 wherein each said first and second support straps comprise a first portion being a substantially inelastic material and a second portion being an elastic material.

20. The adjustable support bra of claim 13 wherein said pivotal attachment means for each of said first and second mini support cups is releasably attachable to at least respective first and second selective pivotal locations of said first and second breast cups.

21. A brassiere comprising:

a bra band;

at least one breast cup; each said at least one breast cup secured to a portion of said bra band;

a shoulder strap for each said at least one breast cup;

a mini support cup for each of said at least one breast cup, having a first end and a second end; said first end of said mini support cup pivotally attached at a selective pivotal location on said at least one breast cup to produce a desired amount of lift, in at least a first direction, for a wearer's breast therein; and a support strap for each of said at least one breast cup, a portion of said support strap secured to a portion of said mini support cup, said support strap having a first end adjustably securable to said shoulder strap and moveable between at least first and second positions on said shoulder strap to provide for pivoting of said mini support cup to produce said desired amount of lift along said at least a first direction, and a second end secured to a portion of said at least one breast cup.

22. The adjustable support bra of claim 21 wherein said shoulder strap extends from a substantially central portion of said breast cup, with respect to said bra band; and wherein said support strap generally spans diagonally across said breast cup, with said second end of said support strap attaching at a lower inside portion of said breast cup, and with said first end of said support strap adjustably attached to said shoulder strap at either of said first or second positions.

23. The adjustable support bra of claim 21 wherein said at least one breast cup comprises a first breast cup attached at a first location on said bra band, and a second breast cup attached at a second location on said bra band, with a corresponding first shoulder strap, first mini support cup, and first support strap for said first breast cup, and a corresponding second shoulder strap, second mini support cup, and second support strap for said second breast cup; and wherein said first mini support cup is pivotally attached at a selective pivotal location on said first breast cup, and said second mini support cup is pivotally attached at a selective pivotal location on said second breast cup.

24. The adjustable support bra of claim 21 wherein when said first end of each of said first and second support straps is respectively adjusted from said first position to said second position, said first and second mini support cups each pivot to produce said desired amount of lift, said at least a first direction of lift for said first and second mini support cups comprising a vertical component of lift being generally away from said bra band, and a horizontal component of lift being generally along said bra band, whereby said horizontal component of lift for said first and second breast cups is in opposite directions to provide outward separating lift.

25. The adjustable support bra of claim 21 wherein said mini support cup comprises a pad and a flexible stiffening member secured at a bottom of said pad.

26. The adjustable support bra of claim 21 further comprising a tricot liner being secured to an inner portion of said at least one breast cup to cover said mini support cup and at least a portion of said support strap.

27. The adjustable support bra of claim 21 further comprising a secondary padding layer, said secondary padding layer being positioned between said at least one breast cup, and said mini support cup.

28. The adjustable support bra of claim 25 further comprising a curved underwire in a bottom of said at least one breast cup.

29. The adjustable support bra of claim 28 wherein said flexible stiffening member is curved to correspond to a portion of said curved underwire.

30. The adjustable support bra of claim 21 wherein said support strap comprises a first portion being a substantially inelastic material and a second portion being an elastic material.

31. The adjustable support bra of claim 21 wherein said at least one breast cup comprises an elastic material.

32. The adjustable support bra of claim 21 wherein said pivotal attachment of said mini support cup comprises a releasable pivotal attachment at said selective pivotal location; and wherein said selective pivotal location comprises two or more pivotal locations, each said two or more pivotal locations comprising a female snap member configured to releasably receive a male snap member fixedly secured to said for mini support cup, said mini support cup being movable between at least said first and said second selective pivotal locations of said two or more locations by using said male and female snap members.

33. A brassiere comprising:

a bra band;

at least one breast cup; each of said at least one breast cup secured to a portion of said bra band;

a shoulder strap for each of said at least one breast cup;

a mini support cup for each of said at least one breast cup;

a elastic fabric member, said elastic fabric member having a first side secured to a portion of a bottom of said at least one breast cup, and a second side secured to said mini support cup;

a support strap for each of said at least one breast cup, a portion of said support strap secured to a portion of said mini support cup, with a first end of said support strap adjustably securable to said shoulder strap and movable between at least first and second positions on said shoulder strap; and wherein when said support strap is adjusted from said first position to said second position, said mini support cup rises to produce desired lifting, with said elastic fabric member expanding to fill a gap formed therebetween.

34. The brassiere according to claim 33 wherein said elastic fabric member comprises a gathered elastic member secured to an inner surface of the bottom of said at least one breast cup.

35. The brassiere according to claim 34 wherein said gathered elastic member is secured to a bottom surface of said mini support cup.

36. The brassiere of claim 35 wherein when said support strap first end is adjusted from said first position to said second position, and when said mini support cup is raised from a first position to a second position in said at least one breast cup said desired lifting comprising vertical lifting of a wearer's breast.

37. The brassiere of claim 35 wherein when said support strap first end is adjusted from said first position to said second position, and when said mini support cup is raised from a first position to a second position, said desired lifting comprising a component of vertical lifting being generally away from said bra band, and a component of horizontal lifting being generally along said bra band.

38. The brassiere of claim 35 wherein said at least one breast cup comprises an elastic material.

39. The brassiere of claim 35 wherein said support strap is secured to said mini support cup at least at an upper edge of said mini support cup.

40. The brassiere of claim 39 wherein said support strap comprises a first portion and a second portion: said first portion being from said first end of said support strap and said attachment at said mini support cup, and comprising a substantially inelastic material; said second portion being from said second end of said support strap and said attachment at said mini support cup, and comprising an elastic material.

41. A brassiere comprising:

a bra band;

at least one breast cup; each said at least one breast cup secured to a portion of said bra band;

a shoulder strap for each of said at least one breast cup;

a mini support cup for each of said at least one breast cup;

a support strap for each of said at least one breast cup, a portion of said support strap secured to a portion of said mini support cup, with a first end of said support strap adjustably securable to said shoulder strap to be movable between at least first and second positions; and wherein when said support strap is adjusted from said first position to said second position, said mini support cup rises to produce desired lifting of the wearer's breast.

42. The brassiere according to claim 41 wherein said mini support cup has a lower curved edge having a stiffening member attached thereto, said stiffening member having a curvature and being adjacent to a bottom of the breast cup.

43. The brassiere according to claim 42 wherein the breast cup includes an underwire and said stiffening member of the mini support cup is nested in a curved portion of the underwire.

44. The adjustable support bra of claim 1 wherein said at least one breast cup comprises a first breast cup and a second breast cup, with a corresponding first shoulder strap, first mini support cup, and first support strap for said first breast cup, and a corresponding second shoulder strap, second mini support cup, and second support strap for said second breast cup; and wherein said first mini support cup is pivotally attached at a selective pivotal location on said first breast cup, and said second mini support cup is pivotally attached at a selective pivotal location on said second breast cup.

45. The adjustable support bra of claim 44 wherein when said first end of said first support strap is adjusted from said first position to said second position, and when said first end of said second support strap is adjusted from said corresponding first position to said second position, said first mini support cup is configured to rotate about said selective pivotal location on said first breast cup and said second mini support cup is configured to rotate about said selective pivotal location on said second breast cup, for said desired lift to thereby provide a vertical component of support being generally directed away from said bra band, and a horizontal component creating outward separating support being generally along said bra band, whereby said outward separating support for each said first and second breast cups is provided by said respective horizontal components of said lift being generally along said bra band in opposite directions.

46. The adjustable support bra of claim 45 wherein said pivotal attachment of said first and second mini support cups comprises a releasable attachment.

47. The adjustable support bra of claim 46 wherein said releasable pivotal attachment of said first and second mini support cups comprises a snap fastener, said snap fastener comprising a male member fixedly secured to each said first and second mini support cups, and a female member fixedly secured to each said first and second breast cups, respectively, at said corresponding selective pivotal locations; said female members configured to be releasable engaged by said male members.

48. The adjustable support bra of claim 47, wherein said selective pivotal location on said first breast cup comprises a first pivotal location thereon with a corresponding female member, and at least a second pivotal location thereon with a corresponding female member, said second pivotal location being incrementally separated from said first pivotal location; and wherein said selective pivotal location on said second breast cup comprises a first pivotal location thereon with a corresponding female member, and at least a second pivotal location thereon with a corresponding female member, said second pivotal location on said second breast cup being incrementally separated from said first pivotal location on said second breast cup.

* * * * *